US005480326A

United States Patent [19]

Chen

[11] Patent Number: 5,480,326

[45] Date of Patent: Jan. 2, 1996

[54] ELECTRICAL JACK ASSEMBLY FOR MODULAR PLUGS

[76] Inventor: Michael Chen, No. 11, Alley 16, Lane 337, Sec. 1, Ta Tung Rd., Hsi Chih Chen Taipei Hsien, Taiwan

[21] Appl. No.: 214,117

[22] Filed: Mar. 16, 1994

[51] Int. Cl.[6] ..... H01R 13/648

[52] U.S. Cl. ..... 439/607; 439/108

[58] Field of Search ..... 439/607–610, 439/92, 95, 101, 108, 675

[56] References Cited

U.S. PATENT DOCUMENTS 5,083,945 1/1992 Miskin et al. ..... 439/607

5,288,248 2/1994 Chen ..... 439/607

5,338,215 3/1993 Lee et al. ..... 439/607

*Primary Examiner*—Daniel W. Howell

*Assistant Examiner*—Hien D. Vu

[57] ABSTRACT

An electrical jack assembly for modular plugs, includes a jack unit, and an electrical shielding metal shell covered on the jack unit, the electrical shielding metal shell being made from an integral metal plate by punching and then bent into shape over the jack unit to cover same and protect its inside circuit against outside noises.

4 Claims, 4 Drawing Sheets

ELECTRICAL JACK ASSEMBLY FOR MODULAR PLUGS

BACKGROUND OF THE INVENTION

The present invention relates to a jack assembly for modular plugs, and more particularly to such a jack assembly which has an electrical shielding in the form of an integral metal shell that effectively protects the circuit against outside interference.

Various electric jacks have been designed for modular plugs for connection to printed circuit boards. In order to protect the inside circuit against outside noises, an electrical shielding metal shell is commonly provided and covered over the jack. FIG. 1 shows an electrical shielding metal shell for this purpose. As illustrated, the electrical shielding metal shell is constructed of two separate parts, namely, the top metal shell part covered on the front side of the jack body, and the bottom metal shell part fastened to the top metal shell part at the bottom and covered over the other sides of the jack body. This structure of electrical shielding metal shell is still not satisfactory in function. Because the electrical shielding metal shell is constructed of two parts, there are gaps between the top metal shell part and the bottom metal shell part, and therefore interference of outside noises or leakage of internal radio waves cannot be effectively prevented. Another drawback of this structure of electrical shielding metal shell is its complicated processing procedure and expensive manufacturing cost. Still another drawback of this structure of electrical shielding metal shell is that the top metal shell part and the bottom metal shell part may disconnect from each other easily, thus rendering the electrical shielding metal shell unable to effectively protect against outside noises.

SUMMARY OF THE INVENTION

The present invention has been accomplished to provide a jack assembly which eliminates the aforesaid drawbacks. This object is achieved by providing an integral electrical shielding metal shell. The electrical shielding metal shell in accordance with the present invention is made from an integral metal plate through a punching process, and therefore the manufacturing procedure of the electrical shielding metal shell is simple. Because the electrical shielding metal shell is made of an integral metal plate, it effectively protects the inside circuit against outside noises when it is covered over the jack body.

DETAILED DESCRIPTION OF THE PREFERRED EMBODIMENT

Figure 1:
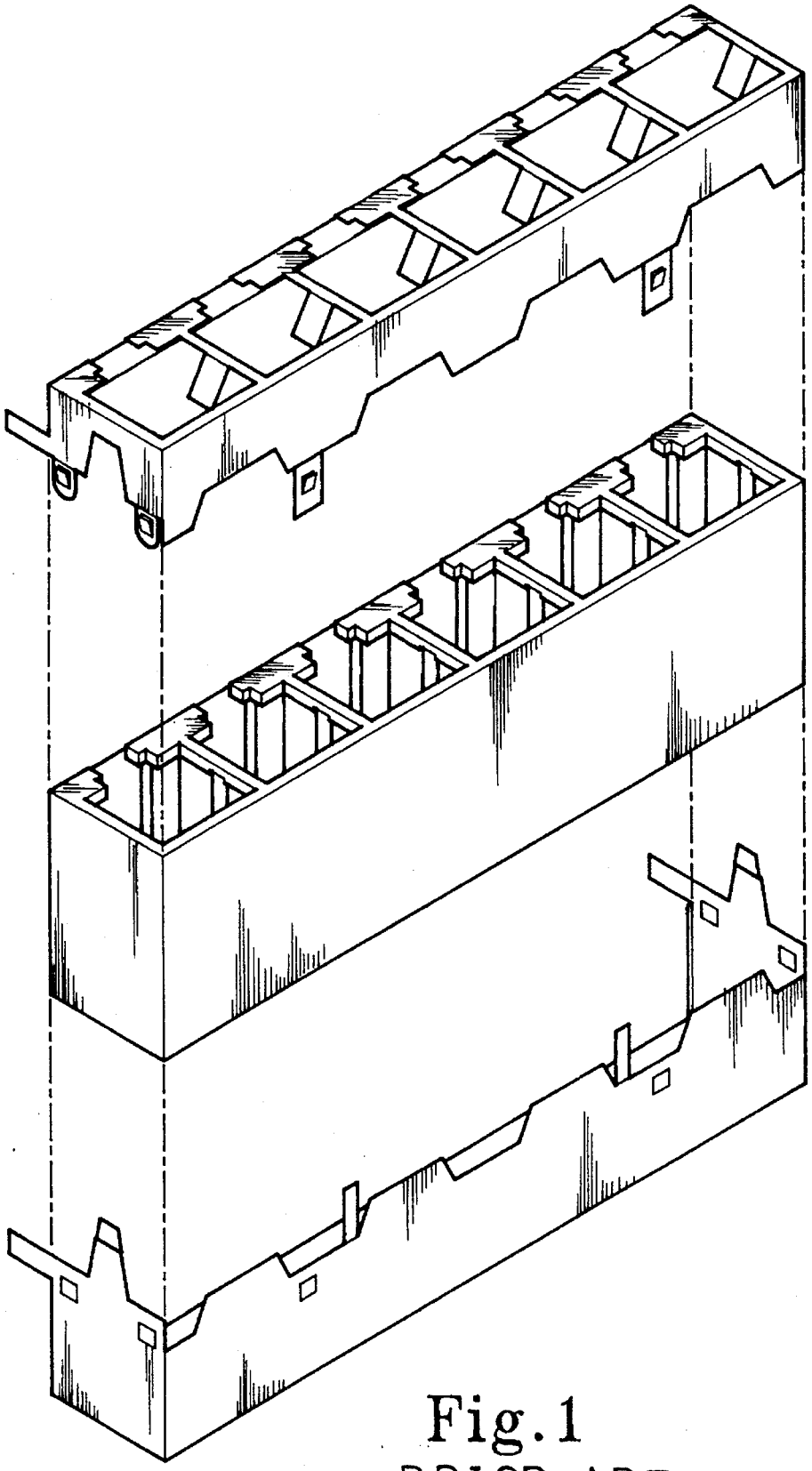
Fig. 1 PRIOR ART
FIG. 1 is an exploded perspective view of an electrical shielding metal shell according to the prior art.
Figure 2:
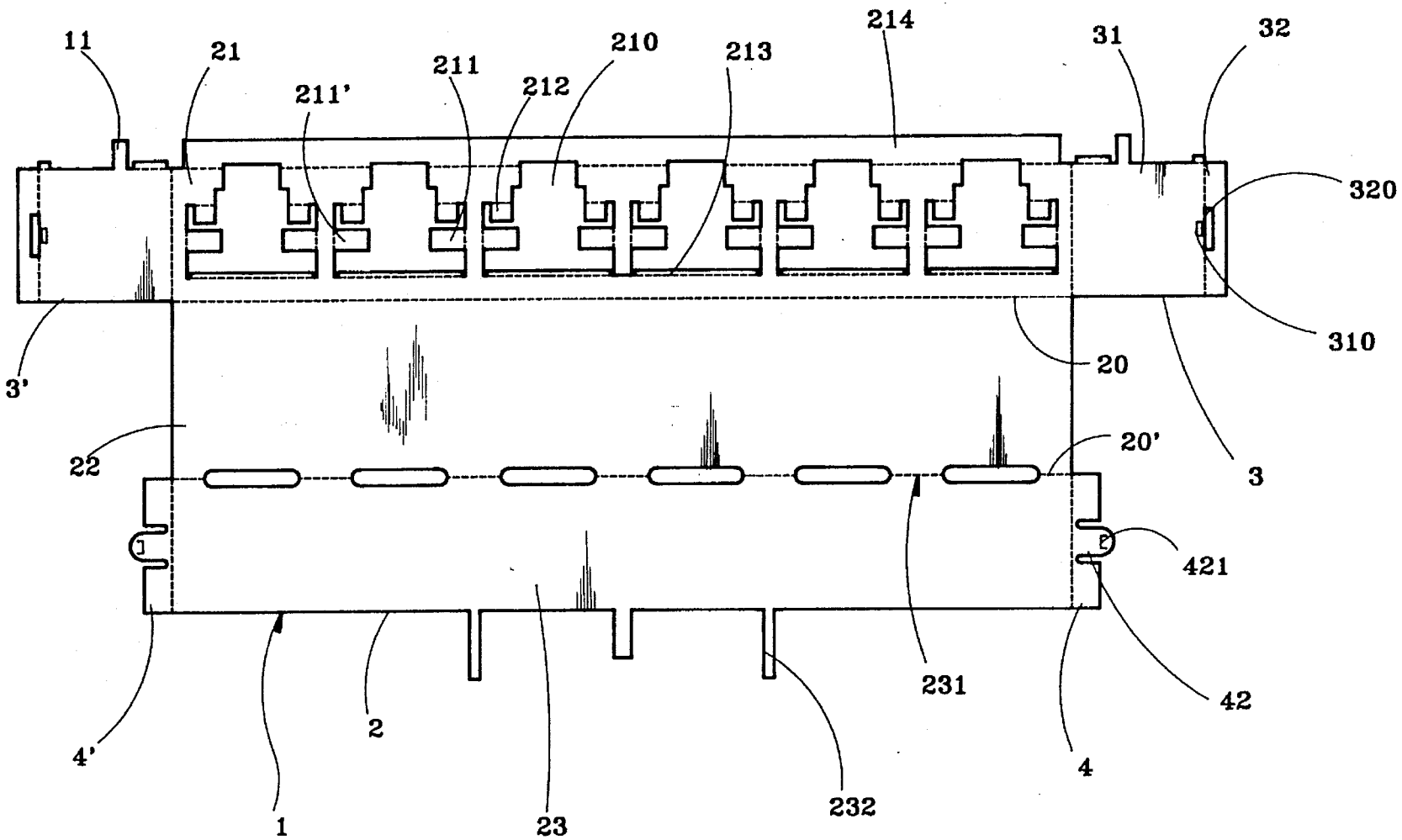
FIG. 2 is a top plan view of an electrical shielding metal shell according to the present invention in a flat condition.
Figure 3:
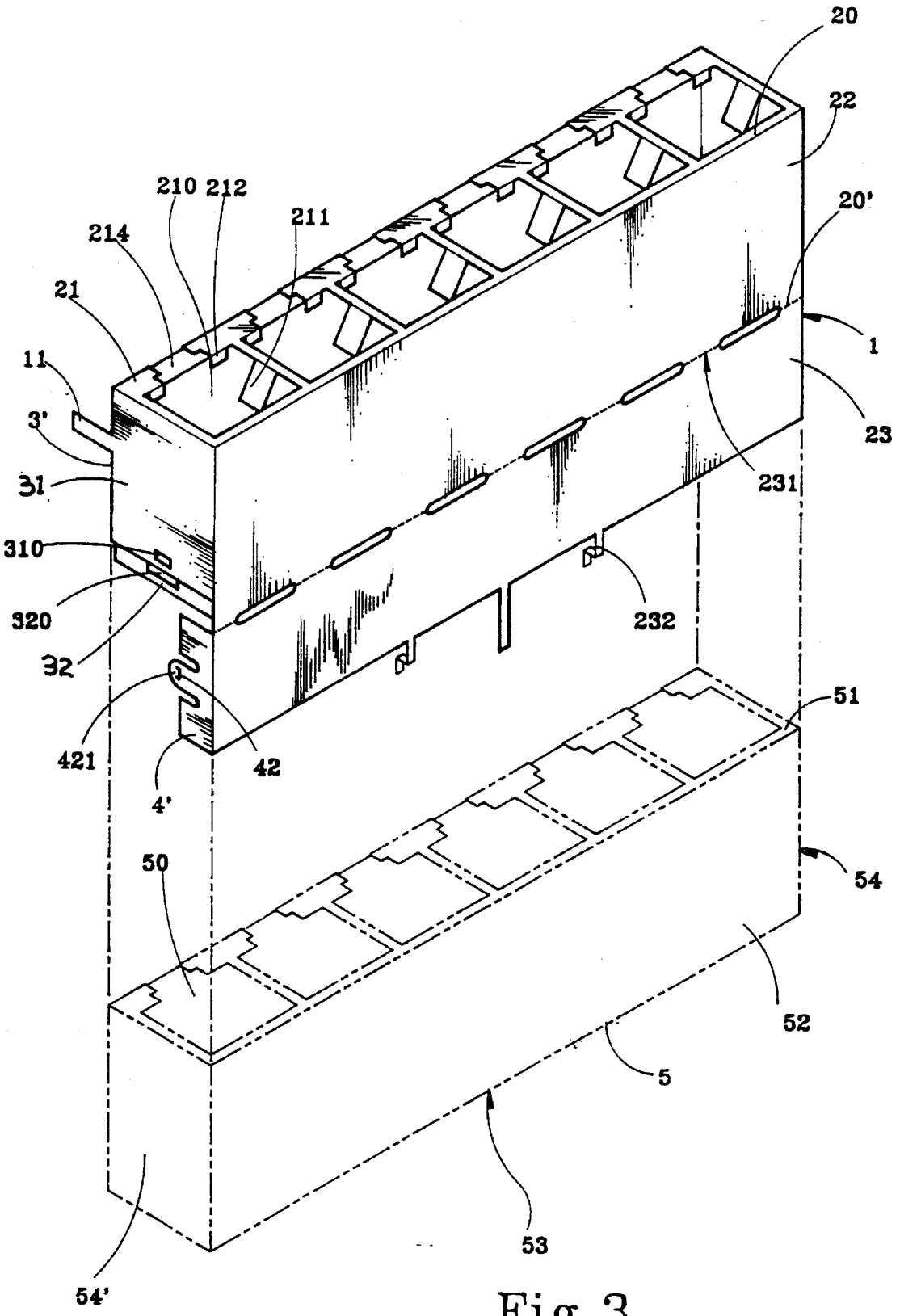
FIG. 3 is a perspective view showing the electrical shielding metal shell of FIG. 2 arranged into a mounting condition for holding a jack unit.

Referring to FIGS. 2 and 3, an electrical jack assembly in accordance with the present invention is generally comprised of a jack unit 5, and an electrical shielding metal shell 1 made from a metal plate by punching and comprising a base plate 2, two side panels 3;3', and two side wings 4;4'. During the processing of the electrical shielding metal shell

1, the base plate 2 is punched with two parallel folding lines 20;20' along the length. The folding lines 20;20 divide the base plate 2 into a first panel 21, a second panel 22, and a third panel 23. When the base plate 2 is bent into shape and covered over the jack unit 5, the first panel 21, second panel 22 and third panel 23 of the base plate 2 are respectively covered over the front side 51, top side 52 and back side 53 of the jack unit 5. The first panel 21 has a plurality of openings 210 corresponding to the plug holes 50 on the jack unit 5 for inserting modular plugs. At each opening 210, there are flanges 212;213 fitted over the inside wall of the respective plug hole 50 on the jack unit 5, and opposite projecting strips 211;211' projected into the respective plug hole 50 for connection to ground.

Figures 4, 4A:
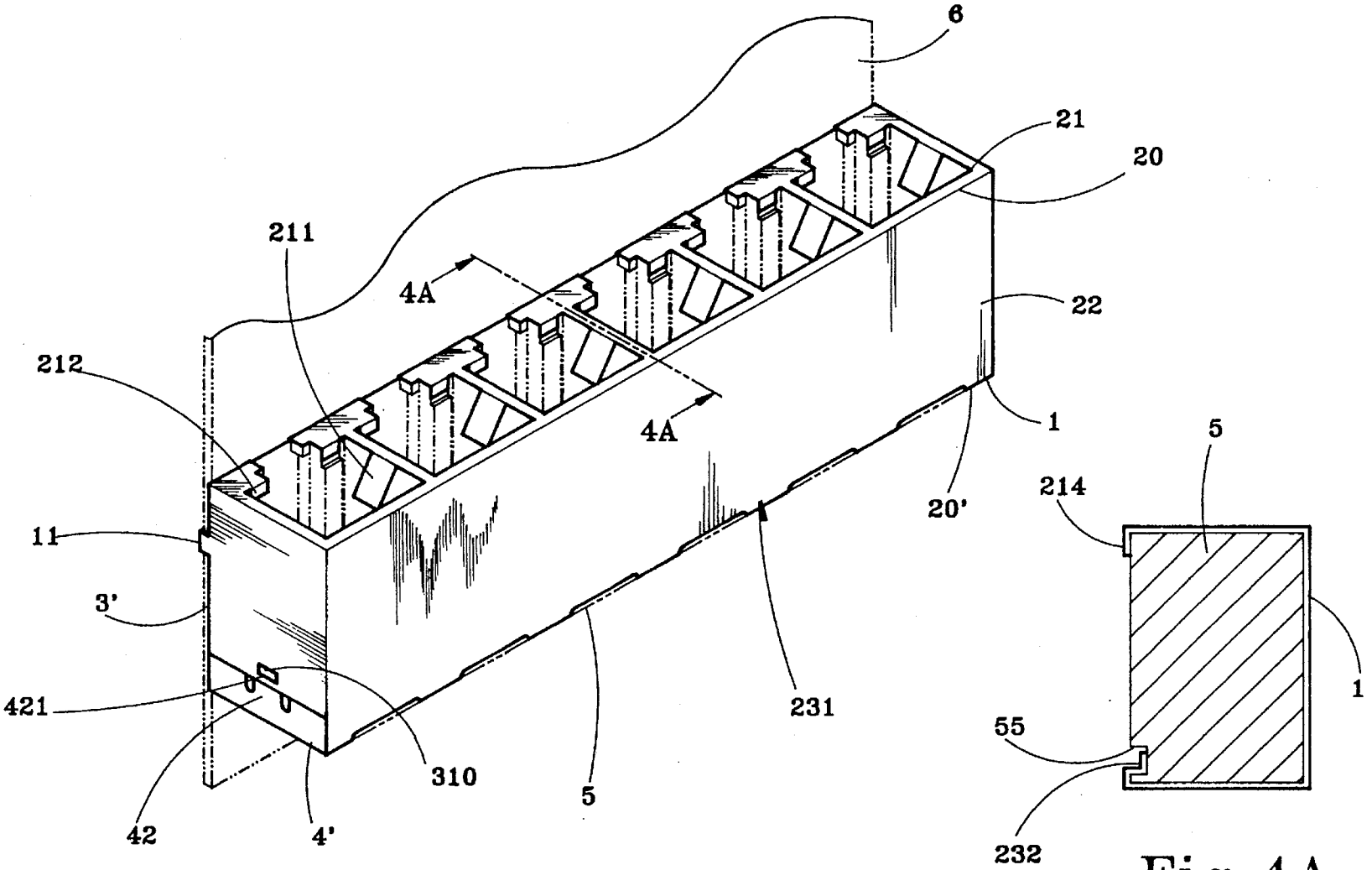
FIG. 4 is a perspective view showing the electrical shielding metal shell of FIG. 3 arranged into a finished shape with the jack unit received on the inside.
FIG. 4A is a section view taken on line 4A—4A of FIG. 4.

Referring to FIG. 4 and FIGS. 2 and 3 again, the aforesaid side panels 3;3' are respectively extended from two opposite ends of the first panel 21 for covering the two opposite lateral sides 54;54' of the jack unit 5. The aforesaid side wings 4;4' are respectively extended from two opposite ends of the third panel 23 and fastened to the side panels 3;3'. The side panel 3 or 3' comprises a first flat panel portion 31 extended from either end of the first panel 21 and a second flat panel portion 32 extended from the first flat panel portion 31 at a different elevation. The second flat panel portion 32 has a slot 320 in the middle thereof adjacent to the first flat panel portion 31. The first flat panel portion 31 has a slot 310 in the middle thereof adjacent to the second flat panel portion 32, the slot 310 being relatively smaller than the slot 320 on the second flat panel portion 32. The side wing 4 or 4' has a projection 42 and a hooked portion 421 raised from the projection 42. By inserting the projection 42 into the slot 320 of the second flat panel portion 32 and hooking the hooked portion 421 in the slot 310 of the first flat panel portion 31, the side wing 4 or 4' is fastened to the side panel 3 or 3', and therefore the two opposite lateral sides 54;54' of the jack unit 5 are positively covered by the side panels 3;3' and side wings 4;4'. The folding line 231 between the second and third panels 22;23 is punched into a broken line 231, and therefore the third panel 23 is kept connected to the second panel 22 when it is folded up and covered over the back side 53 of the jack unit 5.

Referring to FIG. 4A and FIGS. 3 and 4 again, the first panel 21 further comprises a longitudinal side flange 214 fitted over the bottom side (not shown) of the jack unit 5 and fastened to the printed circuit board 6. The third panel 23 further comprises a plurality of locating hooks 232 hooked in respective retaining holes 55 on the bottom side of the jack unit 5. Furthermore, the side panels 3;3' each have a locating strip 11 fastened to the back side of the printed circuit board 6. Therefore, when installed, the electrical shielding metal shell 1 is fastened to the printed circuit board 6 to hold the jack unit 5 in place and to electrically protect the jack unit 5 against interference from outside noises.

While only one embodiment of the present invention has been shown and described, it will be understood that various modifications and changes may be made without departing from the spirit and scope of the invention.

I claim:

1. An electrical jack assembly comprising a jack unit and an electrical shielding metal shell covered on said jack unit, said jack unit formed with a rectangular configuration having a front side with a plurality of plug holes, a back side, a top side, a bottom side for mounting on a printed circuit board, and two opposite lateral sides, wherein said electrical shielding metal shell is made from an a single metal plate comprising a first panel covered over the front side of said jack unit, a second panel covered over the top side of said jack unit, a third panel covered over the back side of said jack unit, two side panels respectively extended from said first panel at two opposite sides thereof and covered on the two opposite lateral sides of said jack unit, two side wings respectively extended from said third panel at two opposite sides thereof and fastened to said side panels and covered on the two opposite lateral sides of said jack unit at a lower portion of each of said lateral sides a first folding line disposed between said first panel and said second panel, and a second folding line disposed between said second panel and said third panel, each of said side panels including a first flat panel portion extended from a side of said first panel and a second flat panel portion extended and offset from the first flat panel portion said second flat panel portion having a slot in the middle thereof adjacent to said first flat panel portion, said first flat panel portion having a slot in the middle thereof adjacent to said second flat panel portion, each of said side wings including a projection inserted into the slot of the second flat panel portion of either side panel and a hooked portion raised from the projection and hooked in the slot on the first flat panel portion of the corresponding side panel.

2. The jack assembly of claim 1 wherein said first panel has a plurality of openings respectively aligned with the plug holes of said jack unit for inserting modular plugs.

3. The jack assembly of claim 2 wherein said first panel comprises a plurality of pairs of opposite projecting strips, each pair of said strips being projected into a corresponding plug hole on the front side of said jack unit for connection to ground.

4. The jack assembly of claim 1 wherein said second folding line is a broken line comprised of a line of spaced punched holes.

* * * * *